US012806674B2

(12) United States Patent
Taniguchi

(10) Patent No.: US 12,806,674 B2
(45) Date of Patent: Nov. 24, 2026

(54) PIPE BODY FORMING APPARATUS

(71) Applicant: Fuji Machine Works Co., Ltd., Osaka (JP)

(72) Inventor: Hideshi Taniguchi, Osaka (JP)

(73) Assignee: FUJI MACHINE WORKS CO., LTD., Osaka (JP)

( * ) Notice: Subject to any disclaimer, the term of this patent is extended or adjusted under 35 U.S.C. 154(b) by 129 days.

(21) Appl. No.: 19/063,258

(22) Filed: Feb. 25, 2025

(65) Prior Publication Data

US 2025/0360547 A1 Nov. 27, 2025

(30) Foreign Application Priority Data

May 22, 2024 (JP) ..... 2024-083043

(51) Int. Cl.

| | |
|---|---|
| ***B21D 37/12*** | (2006.01) |
| ***B21D 5/00*** | (2006.01) |
| ***B21D 5/01*** | (2006.01) |
| ***B21D 5/12*** | (2006.01) |

(52) U.S. Cl.

CPC ..... *B21D 5/015* (2013.01); *B21D 5/002* (2013.01); *B21D 5/12* (2013.01); *B21D 37/12* (2013.01)

(58) Field of Classification Search

CPC ..... B21D 5/015; B21D 5/002; B21D 5/10; B21D 5/12; B21D 37/10; B21D 37/12

See application file for complete search history.

(56) References Cited

U.S. PATENT DOCUMENTS

| | | | | |
|---|---|---|---|---|
| 11,207,722 | B2 * | 12/2021 | Ford | B21D 22/025 |
| 2004/0250404 | A1 * | 12/2004 | Cripsey | B21C 37/0815 72/368 |
| 2022/0402010 | A1 * | 12/2022 | Ohashi | B21D 5/015 |

FOREIGN PATENT DOCUMENTS

| | | | | |
|---|---|---|---|---|
| DE | 102014018543 | A1 * | 6/2016 | B21D 5/015 |
| JP | 2013252546 | A | 12/2013 | |
| JP | 2015211983 | A * | 11/2015 | |
| JP | 2020078820 | A | 5/2020 | |

* cited by examiner

*Primary Examiner* — Atul P. Khare

(74) *Attorney, Agent, or Firm* — Renner, Otto, Boisselle & Sklar, LLP

(57) ABSTRACT

A pipe body forming apparatus includes: a core restricted in rotation about an axis; an abutment body that interposes a center portion of a workpiece between the core and the abutment body; a first pressure member and a second pressure member that are allowed to be pressed against the core from both sides in a horizontal direction with the workpiece interposed between the core and each of the first pressure member and the second pressure member; and a correcting body allowed to be pressed against the core from an opposite side to the abutment body with both edge portions of the workpiece interposed between the core and the correcting body. By pressing the workpiece from four directions perpendicular to each other with respect to the core, the workpiece is formed into a pipe body having an inner dimension matching an outer dimension of the core.

4 Claims, 6 Drawing Sheets

1051
105
101
11
6
8
S1
W
17
P1
32A
32B
L1
2
7
10
61
31A
31B

PIPE BODY FORMING APPARATUS

CROSS REFERENCE

This Nonprovisional application claims priority under 35 U.S.C. § 119 (a) on Patent Application No. 2024-083043 filed in Japan on May 22, 2024, the entire contents of which are hereby incorporated by reference.

BACKGROUND OF THE INVENTION

1. Field of the Invention

The present invention relates to a pipe body forming apparatus that forms a rectangular metallic flat plate as a workpiece into a pipe shape by performing bending while interposing the workpiece between a plurality of rolls.

2. Description of Related Art

According to a known method of manufacturing a metallic pipe body, a rectangular metallic flat plate as a workpiece is bent into a cylindrical shape using a roll forming apparatus, and then two parallel edge portions are joined to each other using a machine such as a welder. The roll forming apparatus has a plurality of rolls including one main roll and one or more secondary rolls that are arranged with respective axes extending in directions parallel to each other. The workpiece is plastically deformed by bending in passing through between the main roll and the secondary roll to be formed into a cylindrical shape.

A conventional and usual roll forming apparatus includes a three-roll forming apparatus with a main roll and two secondary rolls made of a material having comparable hardness to a material of the main roll (see Japanese published unexamined patent application No. 2013-252546, for example). The three-roll forming apparatus is suitable for bending into comparatively small diameters. Peripheral surfaces of the secondary rolls do not come into pressure-contact with a peripheral surface of the main roll across the workpiece. Thus, by adjusting the positions of the secondary rolls relative to the main roll, it becomes possible to change a bending radius easily.

However, the conventional three-roll forming apparatus has difficulty in forming a metallic workpiece having comparatively hardness such as a SUS 304 material with a thickness of 1 mm into a small-diameter cylindrical shape having an outer diameter of about 22 mm. The reason for this is as follows. Large bending stress acts on the workpiece during bending, and releasing the workpiece from between the rolls causes a spring-back phenomenon where an edge portion of the workpiece restores externally due to elastic force. This spring-back phenomenon increases a gap between both edge portions of the workpiece to necessitate a shrinking step in order to perform a subsequent joining step smoothly.

In response to this, the present applicant previously suggested a roll forming apparatus including a main roll, a pinch roll, two side rolls, an edge bending plate, a first moving mechanism, a biasing mechanism, a second moving mechanism, a third moving mechanism, and a controller (see Japanese published unexamined patent application No. 2020-078820).

The main roll and the pinch roll are arranged with respective center axes parallel to each other, and rotatably supported in a manner allowing and the pinch roll to move independently of each other along a centerline connecting the respective centers of the rolls. The two side rolls are arranged on both sides across the centerline with respective center axes parallel to the main roll, and rotatably supported in a manner allowing the side rolls to move closer to and farther from each other. The edge bending plate is arranged on an opposite side to the pinch roll across the main roll, supported movably along the centerline, and has an end surface facing a peripheral surface of the main roll and formed into a shape along the peripheral surface of the main roll. The first moving mechanism moves the main roll toward the pinch roll. The biasing mechanism biases the pinch roll selectively in a direction of bringing the pinch roll into pressure-contact with the main roll. The second moving mechanism moves the two side rolls at the same speed in directions of moving the side rolls closer to and farther from each other. The third moving mechanism moves the edge bending plate back and forth along the centerline.

The controller is configured to perform a bending step and an edge bending step in this order. In the bending step, the biasing mechanism and the first moving mechanism are driven. By doing so, a center portion of a metallic plate material as a workpiece in a peripheral direction is interposed between the main roll and the pinch roll in a thickness direction. In this state, the main roll is moved toward the pinch roll along the centerline while the second moving mechanism is driven to move the two side rolls in the directions of moving the side rolls closer to each other. In the edge bending step, the second moving mechanism is driven to move the two side rolls farther from each other, and the third moving mechanism is driven to move the end surface of the edge bending plate toward the main roll along the centerline.

With this configuration, in the bending step, a sufficient pressing force acts in a peripheral direction of the main roll from the two side rolls on a peripheral surface of the metallic plate material as the workpiece with the center portion thereof in the peripheral direction interposed between the main roll and the pinch roll. Furthermore, in the edge bending step, a sufficient pressing force from the edge bending plate toward the peripheral surface of the main roll acts on both edge portions of the workpiece. As a result, the workpiece is reliably formed into a circular cylindrical shape.

The roll forming apparatus shown in Japanese published unexamined patent application No. 2020-078820 is available for forming a workpiece having comparatively high hardness into a pipe body having a small-diameter circular section. However, this roll forming apparatus is not available for forming into a pipe body having a noncircular section such as a rectangular section with a linear part formed in at least a part of the section or a D-shape section.

SUMMARY OF THE INVENTION

A pipe body forming apparatus according to the present invention includes a core, an abutment body, a first pressure member, a second pressure member, a first rotary mechanism, a second rotary mechanism, a correcting body, a pressure mechanism, a displacement mechanism, a first biasing mechanism, a second biasing mechanism, and a third biasing mechanism.

The core is a columnar body having a sectional shape uniform in an axis direction and restricted in rotation about an axis. The abutment body includes an abutment surface movable closer to and farther from the core relatively in a reference direction corresponding to a particular radial direction of the core, to face the core over an entire area of the core in the axis direction, and used for interposing a plate-like workpiece in the reference direction between the abutment surface and the core. Each of the first pressure member and the second pressure member is a columnar body having a sectional shape that is uniform in an axis direction and has an outer periphery including a linear part and an arc-like part. The first pressure member and the second pressure member are arranged parallel to the core within a reference plane perpendicular to the reference direction while being movable closer to and farther from each other across the reference direction. The first rotary mechanism causes the linear part or the arc-like part of the first pressure member selectively to face the core. The second rotary mechanism causes the linear part or the arc-like part of the second pressure member selectively to face the core. The correcting body includes a correcting surface to face the core over an entire area of the core in the axis direction on an opposite side to the abutment body across the core. The correcting surface conforms to a peripheral surface of the workpiece interposed between the abutment surface and the core. The correcting body is supported movably in the reference direction relative to the core.

The pressure mechanism allows the core and the abutment surface to interpose the workpiece therebetween. The displacement mechanism changes a relative position of the workpiece to the reference plane in the reference direction with the workpiece interposed between the core and the abutment surface. The first biasing mechanism and the second biasing mechanism bias the first pressure member and the second pressure member in directions of moving the first pressure member and the second pressure member closer to each other while the workpiece interposed between the core and the abutment surface moves from an initial position to a finish position across the reference plane along with the change in the relative position. The third biasing mechanism allows the correcting surface to be pressed against a peripheral surface of the core with both edge portions of the workpiece interposed between the correcting surface and the core, between the first pressure member and the second pressure member moved farther from each other after the workpiece reaches the finish position.

DETAILED DESCRIPTION OF THE EMBODIMENTS

Figure 1:
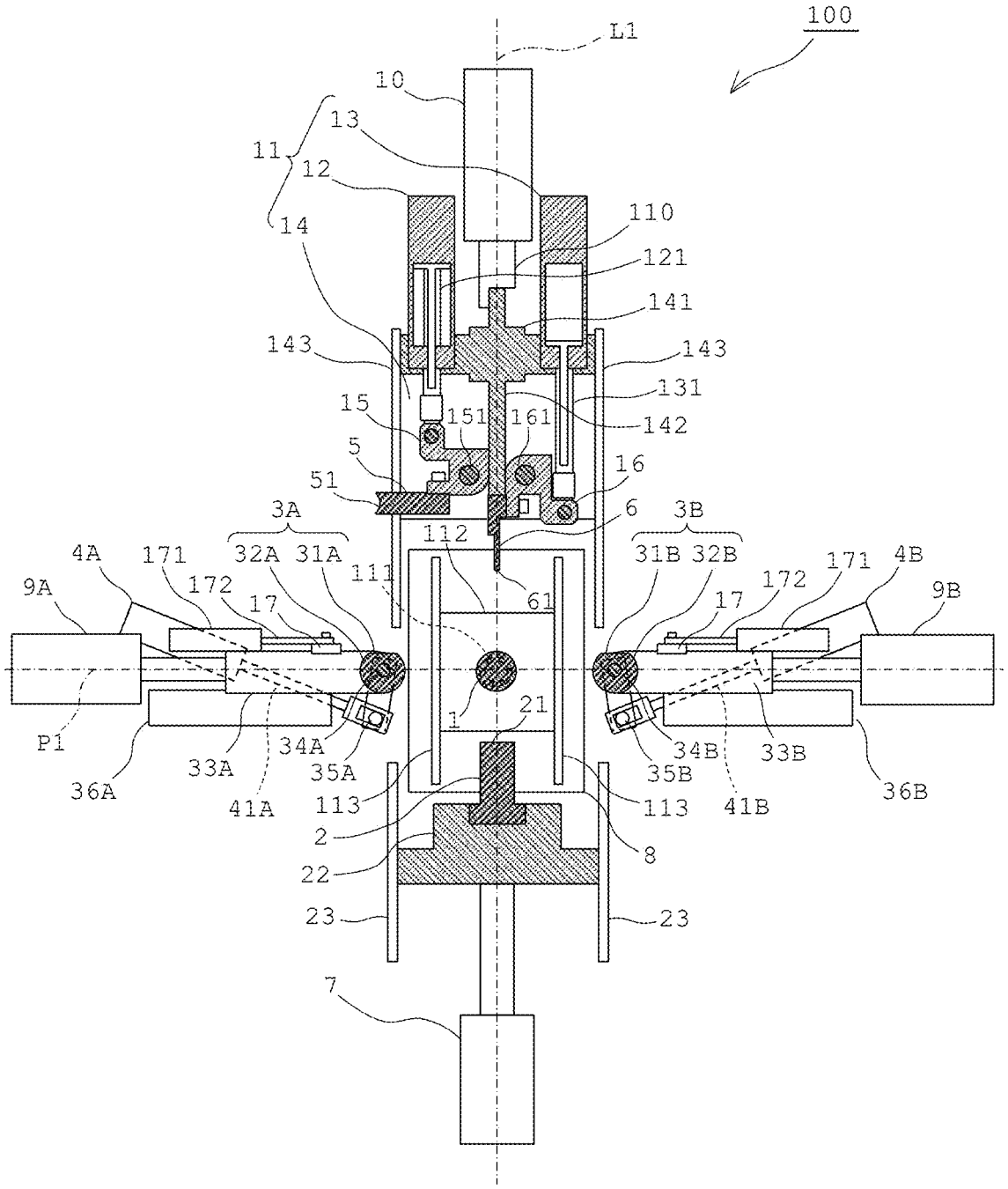
FIG. 1 is a sectional view of a pipe body forming apparatus according to a first embodiment of the present invention.

The present invention provides a pipe body forming apparatus allowing a rectangular metallic flat plate as a workpiece to be formed easily not only into a pipe body having a small-diameter circular section but also into a pipe body having a noncircular section including a linear part in at least a part of the section.

The pipe body forming apparatus includes a core, an abutment body, a first pressure member, a second pressure member, a first rotary mechanism, a second rotary mechanism, a correcting body, a pressure mechanism, a displacement mechanism, a first biasing mechanism, a second biasing mechanism, and a third biasing mechanism.

The core is a columnar body having a sectional shape uniform in an axis direction and restricted in rotation about an axis. The abutment body includes an abutment surface movable closer to and farther from the core relatively in a reference direction corresponding to a particular radial direction of the core, to face the core over an entire area of the core in the axis direction, and used for interposing a plate-like workpiece in the reference direction between the abutment surface and the core. Each of the first pressure member and the second pressure member is a columnar body having a sectional shape that is uniform in an axis direction and that has an outer periphery including a linear part and an arc-like part. The first pressure member and the second pressure member are arranged parallel to the core within a reference plane perpendicular to the reference direction while being movable closer to and farther from each other across the reference direction. The first rotary mechanism causes the linear part or the arc-like part of the first pressure member selectively to face the core. The second rotary mechanism causes the linear part or the arc-like part of the second pressure member selectively to face the core. The correcting body includes a correcting surface to face the core over an entire area of the core in the axis direction on an opposite side to the abutment body across the core. The correcting surface conforms to a peripheral surface of the workpiece interposed between the abutment surface and the core. The correcting body is supported movably in the reference direction relative to the core.

The pressure mechanism allows the core and the abutment surface to interpose the workpiece therebetween. The displacement mechanism changes a relative position of the workpiece to the reference plane in the reference direction with the workpiece interposed between the core and the abutment surface. The first biasing mechanism and the second biasing mechanism bias the first pressure member and the second pressure member in directions of moving the first pressure member and the second pressure member closer to each other while the workpiece interposed between the core and the abutment surface moves from an initial position to a finish position across the reference plane along with the change in the relative position. The third biasing mechanism allows the correcting surface to be pressed against a peripheral surface of the core with both edge portions of the workpiece interposed between the correcting surface and the core, between the first pressure member and the second pressure member moved farther from each other after the workpiece reaches the finish position.

While a part of the rectangular metallic flat plate as the workpiece is interposed between the core and the abutment surface using the pressure mechanism and the workpiece is moved from the initial position toward the finish position using the displacement mechanism, the first biasing mechanism and the second biasing mechanism move the first pressure member and the second pressure member closer to each other with the linear part or the arc-like part of the first rotary mechanism selectively caused to face the core by the first rotary mechanism and with the linear part or the arc-like part of the second rotary mechanism selectively caused to face the core by the second rotary mechanism.

By continuing the motions of the pressure mechanism, the displacement mechanism, the first biasing mechanism, and the second biasing mechanism until the workpiece reaches the finish position, the linear part or the arc-like part of each of the first pressure member and the second pressure member is pressed against the peripheral surface of the core with the workpiece interposed therebetween in a thickness direction. As a result, the workpiece is deformed in such a manner as to conform to the shape of the peripheral surface of the core.

When the workpiece reaches the finish position, the linear part or the arc-like part of the first pressure member and the linear part or the arc-like part of the second pressure member make closest approach to each other, and the both edge portions of the workpiece make closet approach to each other. Then, the first pressure member and the second pressure member are moved farther from each other by a first approach/separation mechanism and a second approach/separation mechanism. When the correcting surface is pressed against the peripheral surface of the core between the first pressure member and the second pressure member using the third biasing mechanism with the both edge portions of the workpiece interposed between the correcting surface and the core, the both edge portions of the workpiece separated from the peripheral surface of the core are interposed between the peripheral surface of the core and the correcting surface to be deformed along the peripheral surface of the core. The workpiece is formed into a pipe body having a shape with an inner peripheral surface entirely conforming to the peripheral surface of the core 1.

The above configuration may include a holding body and a fourth biasing mechanism. The holding body includes a holding surface to face the core over an entire area of the core in the axis direction on an opposite side to the abutment body across the core. The holding body is supported movably in the reference direction relative to the core. The fourth biasing mechanism brings the holding surface and the peripheral surface of the core into pressure-contact with each other in a period from when the workpiece interposed between the core and the abutment surface moves from the initial position to when the workpiece passes through at least the reference plane along with the change in the relative position. As a result of the direct pressure-contact between the holding surface and the peripheral surface of the core over an entire area in the axis direction with a part of the workpiece interposed between the core and the abutment body, deflection of the core in the axis direction can be prevented to allow precise forming into a long pipe body.

In this configuration with the holding body and the fourth biasing mechanism, the pipe body forming apparatus may include a selection mechanism that supports the correcting body and the holding body integrally and movably in the reference direction and causes either the correcting surface or the holding surface to face the core selectively. In the pipe body forming apparatus, the third biasing mechanism may function as the fourth biasing mechanism. As a result, it is possible to simplify the configuration of this pipe body forming apparatus.

The displacement mechanism may support the core movably in the reference direction and may move the core between the initial position and the finish position. This configuration allows the first pressure member, the second pressure member, the first rotary mechanism, and the second rotary mechanism to be fixed in the reference direction, so that it is possible to simplify the configuration.

Pipe body forming apparatuses according to embodiments of the present invention will be described below by referring to the drawings.

As shown in FIG. 1, a pipe body forming apparatus 100 according to a first embodiment of the present invention includes a core 1, an abutment body 2, a first pressure member 3A, a second pressure member 3B, a first rotary mechanism 4A, a second rotary mechanism 4B, a correcting body 5, a holding body 6, a pressure mechanism 7, a displacement mechanism 8, a first biasing mechanism 9A, a second biasing mechanism 9B, a third biasing mechanism 10, and a selection mechanism 11.

The core 1 is a columnar body having a sectional shape uniform in an axis direction. Both end portions of the core 1 in the axis direction are fixed to a slider 112 via a chuck 111 with each of the both end portions restricted in rotation. The slider 112 is movable along a pair of slider guides 113 located at a frame not shown in the drawings. The slider guides 113 extend lengthwise in a direction matching a reference direction L1 corresponding to a particular radial direction of the core 1. The core 1 moves in the reference direction L1 together with the slider 112. In this embodiment, a vertical direction corresponds to the reference direction L1.

The pipe body forming apparatus 100 forms a rectangular metallic flat plate as a workpiece into a pipe body by winding the workpiece on a peripheral surface of the core 1. Thus, the core 1 has a sectional shape matching an inner shape of the pipe body to be formed. The core 1 having the sectional shape responsive to the inner shape of the pipe body to be formed is fixed to the slider 112.

The abutment body 2 includes an abutment surface 21 composed of a horizontal plane whose normal direction matches the reference direction L1. The abutment surface 21 is to face the peripheral surface of the core 1 over an entire area of the core 1 in the axis direction. The abutment surface 21 may be formed into an arc-like shape projecting toward the peripheral surface of the core 1. During pipe body forming by the pipe body forming apparatus 100, the abutment surface 21 is pressed against the peripheral surface of the core 1 in the reference direction L1 with a part of the workpiece interposed therebetween in a thickness direction. The abutment body 2 is fixed to an abutment body mount 22. The abutment body mount 22 is supported movably up and down in the reference direction L1 by a pair of abutment body guides 23.

The first pressure member 3A and the second pressure member 3B are arranged within a reference plane P1 perpendicular to the reference direction L1 and parallel to the core 1 across the reference direction L1. The first pressure member 3A and the second pressure member 3B are rotatably supported by a support mount 33A and a support mount 33B respectively. As an example, the first pressure member 3A and the second pressure member 3B are configured as follows. The first pressure member 3A is a columnar body including a linear part 31A and an arc-like part 32A, and having a sectional shape that is uniform in the axis direction. The second pressure member 3B is a columnar body including a linear part 31B and an arc-like part 32B, and having a sectional shape that is uniform in the axis direction.

The sectional shapes of the first pressure member 3A and the second pressure member 3B can be determined by changing the curvatures of the arc-like part 32A and the arc-like part 32B partially or by providing recess-shaped arc-like parts in parts of the sectional shapes in response to the shape of the pipe body to be formed. During pipe body forming by the pipe body forming apparatus 100, the linear part 31A or the linear part 31B of the first pressure member 3A and the arc-like part 32A or the arc-like part 32B of the second pressure member 3B are each pressed against the peripheral surface of the core 1 within the reference plane P1 with a different part of the workpiece interposed therebetween in the thickness direction.

The first rotary mechanism 4A and the second rotary mechanism 4B are mounted on the support mount 33A and the support mount 33B respectively. The first rotary mechanism 4A and the second rotary mechanism 4B are composed of hydraulic cylinders, for example, and have a shaft 41A and a shaft 41B respectively that are connected to a rotary shaft 34A of the first pressure member 3A and to a rotary shaft 34B of the second pressure member 3B via a link 35A and a link 35B respectively.

When the first rotary mechanism 4A causes the shaft 41A to advance and retreat in the axis direction, the rotary shaft 34A rotates via the link 35A. This motion allows the linear part 31A or the arc-like part 32A of the first pressure member 3A to selectively come to face the peripheral surface of the core 1 in response to strokes of the shaft 41A. When the second rotary mechanism 4B causes the shaft 41B to advance and retreat in the axis direction, the rotary shaft 34B rotates via the link 35B. This motion allows the linear part 31B or the arc-like part 32B of the second pressure member 3B to selectively come to face the peripheral surface of the core 1 in response to strokes of the shaft 41B.

The first biasing mechanism 9A and the second biasing mechanism 9B are hydraulic cylinders fixed to a frame beyond the drawing, for example, and move the support mount 33A and the support mount 33B back and forth along a first pressure member guide 36A and a second pressure member guide 36B respectively with the first pressure member 3A and the second pressure member 3B rotatably supported by the support mount 33A and the support mount 33B respectively, and bias the support mount 33A and the support mount 33B toward the core 1. This configuration allows the first pressure member 3A and the second pressure member 3B to move closer to and farther from each other together with the support mount 33A an the support mount 33B respectively.

The first biasing mechanism 9A and the second biasing mechanism 9B may only have functions of moving the first pressure member 3A and the second pressure member 3B back and forth relative to the core 1. The first biasing mechanism 9A can be composed of a motor including a rotary shaft and a pinion gear that is fixed to the rotary shaft while the pinion gear is in meshing engagement with a rack gear fixed to the support mount 33A, for example. The second biasing mechanism 9B can be composed of a motor including a rotary shaft and a pinion gear that is fixed to the rotary shaft while the pinion gear is in meshing engagement with a rack gear fixed to the support mount 33B, for example. In this case, it is necessary that the first pressure member 3A and the second pressure member 3B be biased toward the core 1 by additionally providing hydraulic cylinders, for example.

The correcting body 5 includes a correcting surface 51 to selectively face the core 1. The correcting surface 51 comes into pressure-contact with both edge portions of the workpiece interposed between the abutment surface 21 and the core 1 during pipe body forming. The correcting surface 51 has a shape conforming to an outer peripheral surface of the workpiece interposed between the abutment surface 21 and the core 1 during pipe body forming. If a part of the peripheral surface of the core 1 to face the correcting body 5 is an arc projecting externally, for example, the section of the correcting surface 51 is configured as a recessed arc having a radius that is equal to the radius of the outer peripheral surface of the workpiece after forming. Here, this radius is determined by adding the thickness of the workpiece to the radius of the core 1.

During pipe body forming by the pipe body forming apparatus 100, the correcting body 5 moves to a position where the correcting surface 51 faces the peripheral surface of the core 1 over an entire area of the core 1 in the axis direction on an opposite side in the reference direction L1 to the abutment body 2 across the core 1. From this state, the correcting body 5 moves closer to the core 1 relatively in the reference direction L1 to press the correcting surface 51 against the core 1 in the reference direction L1 with the both edge portions of the workpiece interposed therebetween in the thickness direction.

The holding body 6 includes a holding surface 61 to selectively face the peripheral surface of the core 1 over an entire area of the core 1 in the axis direction. The holding surface 61 comes into pressure-contact with the peripheral surface of the core 1 during pipe body forming by the pipe body forming apparatus 100. Considering that the sectional shape of the core 1 changes in response to the sectional shape of the pipe body to be formed, the holding surface 61 may be configured as a horizontal plane, more preferably, may be configured as an arc projecting toward the peripheral surface of the core 1.

During pipe body forming by the pipe body forming apparatus 100, the holding body 6 moves to a position where the holding surface 61 faces the peripheral surface of the core 1 over an entire area of the core 1 in the axis direction on an opposite side in the reference direction L1 to the abutment body 2 across the core 1. From this state, the holding body 6 moves closer to the core 1 relatively in the reference direction L1 to bring the holding surface 61 into pressure-contact with the core 1 in the reference direction L1.

The pressure mechanism 7 is a hydraulic cylinder fixed to a frame beyond the drawing, for example. The pressure mechanism 7 moves the abutment body mount 22 back and forth in the reference direction L1 between the pair of abutment body guides 23 with the abutment body 2 fixed to the abutment body mount 22, and biases the abutment body 2 toward the core 1 to interpose a part of the workpiece between the abutment surface 21 and the peripheral surface of the core 1 during pipe body forming. The highest position to which the abutment surface 21 is brought by the biasing force from the pressure mechanism 7 is defined in advance as a start position above the reference plane P1.

The displacement mechanism 8 moves the slider 112 back and forth along the slider guides 113. Before start of pipe body forming, the workpiece is loaded into a position above the reference plane P1 and between the core 1 and the abutment body 2. During pipe body forming, the workpiece moves from the position above the reference plane P1 to a position below the reference plane P1 in a state of being interposed between the peripheral surface of the core 1 and the abutment surface 21. Before start of pipe body forming, a sufficient clearance is required between the core 1 and the abutment surface 21 in order for the workpiece to be loaded therebetween. Meanwhile, after start of pipe body forming, the workpiece is required to be interposed between the peripheral surface of the core 1 and the abutment surface 21. The displacement mechanism 8 moves the core 1 held by the slider 112 independently of the abutment body 2 within a range in which the core 1 moves up and down through the reference plane P1 in the reference direction L1.

The selection mechanism 11 includes a correcting body cylinder 12, a holding body cylinder 13, and a selection mechanism support member 14, for example. The selection mechanism support member 14 is movable in the reference direction L1 between a pair of selection mechanism guides 143. The correcting body cylinder 12 and the holding body cylinder 13 are fixed to a fixing part 141 at the top of the selection mechanism support member 14. The selection mechanism support member 14 includes a pressure part 142 extending over the entire length of the core 1 in the axis direction.

The selection mechanism support member 14 has a lower part where a rotary shaft 151 of a correcting body link 15 and a rotary shaft 161 of a holding body link 16 are rotatably supported. The correcting body link 15 has one end portion where a lower end of a piston rod 121 of the correcting body cylinder 12 is rotatably supported. The correcting body link 15 has the other end portion where the correcting body 5 is fixed. The holding body link 16 has one end portion where a lower end of a piston rod 131 of the holding body cylinder 13 is rotatably supported. The holding body link 16 has the other end portion where the holding body 6 is fixed.

By moving down the piston rod 121 of the correcting body cylinder 12 or the piston rod 131 of the holding body cylinder 13, the correcting body link 15 or the holding body link 16 is rotated to a position where an upper surface of the correcting body 5 or an upper surface of the holding body 6 abuts on a lower surface of the pressure part 142. By moving up the piston rod 121 of the correcting body cylinder 12 or the piston rod 131 of the holding body cylinder 13, the correcting body link 15 or the holding body link 16 is rotated to a position where the upper surface of the correcting body 5 or the upper surface of the holding body 6 is separated from the lower surface of the pressure part 142.

By supplying a fluid selectively to the correcting body cylinder 12 or the holding body cylinder 13 of the selection mechanism 11, either the upper surface of the correcting body 5 or the upper surface of the holding body 6 comes into abutting contact with the lower surface of the pressure part 142 and either the correcting surface 51 or the holding surface 61 comes to face the peripheral surface of the core 1. During pipe body forming, the pipe body forming apparatus 100 selectively causes either the correcting surface 51 or the holding surface 61 to face the peripheral surface of the core 1 with the selection mechanism 11.

The third biasing mechanism 10 is composed of a hydraulic cylinder, for example, and includes a rod 110 having a lower end portion with which an upper end portion of the pressure part 142 is engaged. In response to advancing and retreating motions of the rod 110, the third biasing mechanism 10 moves the upper end portion of the pressure part 142 up and down to move the selection mechanism support member 14 back and forth in the reference direction L1 between the pair of selection mechanism guides 143. This changes a relative position of the peripheral surface of the core 1 to the correcting surface 51 or the holding surface 61. A downward pressing force acting from the third biasing mechanism 10 on the correcting body 5 or the holding body 6 is larger than an upward pressing force acting from the pressure mechanism 7 on the abutment body 2.

The pipe body forming apparatus 100 includes two or more pairs of positioning rolls 17. The positioning rolls 17 are arranged in the axis direction of the core 1, and come into abutting contact with both edge surfaces of the workpiece loaded into the pipe body forming apparatus 100 to define the position of the workpiece before start of pipe body forming. On an external side of each of the first pressure member 3A and the second pressure member 3B in a horizontal direction, the positioning rolls 17 are each rotatably supported by a movable part 172 of a moving mechanism 171 mounted on each of the support mount 33A and the support mount 33B with a peripheral surface of each positioning roll 17 facing a top surface of each of the first pressure member 3A and the second pressure member 3B. In response to advancing and retreating motions of the movable part 172, the positioning rolls 17 move closer to and farther from the both edge surfaces of the workpiece.

Figures 2A, 2B, 2C, 2D, 2E, 2F, 2G, 2H:
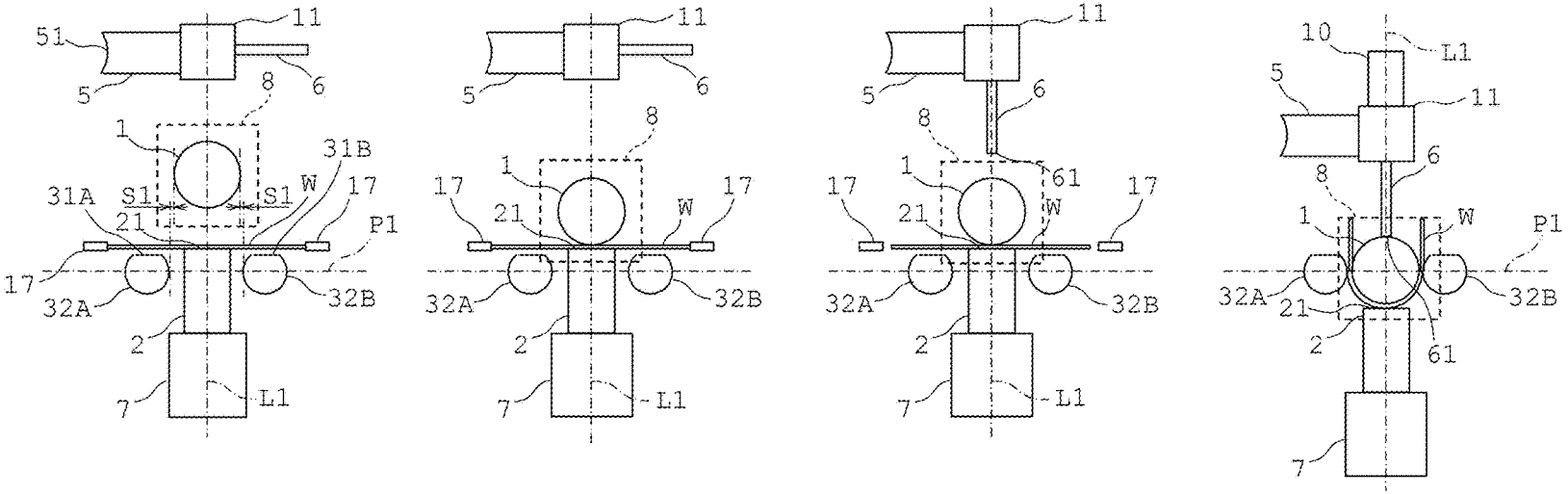
FIGS. 2A to 2H are side schematic views showing motions during forming into a circular pipe body by the pipe body forming apparatus.

As shown in FIG. 2A, the pipe body forming apparatus 100 forms a rectangular metallic flat plate as a workpiece W into a pipe body having a circular section using the core 1 having an outer diameter corresponding to the inner diameter of the pipe body to be formed and the correcting body 5 including the correcting surface 51 of an arc-like shape having a diameter equal to the outer diameter of the pipe body to be formed. The first pressure member 3A and the second pressure member 3B are fixed at rotary positions where the linear part 31A and the linear part 31B are pointed horizontally upward, and are fixed at positions where a tangential distance S1 to the core 1 corresponds to the thickness of the workpiece W. Furthermore, the abutment surface 21 of the abutment body 2 is located at the same height position as the positioning roll 17, and the core 1 is separated upward from the abutment surface 21.

In this state, the workpiece W is placed on the abutment body 2, and the positioning roll 17 matches the center of the workpiece W to the reference direction L1 (see FIG. 2A). Then, the displacement mechanism 8 moves down the core 1 to interpose a center portion of the workpiece W between the core 1 and the abutment body 2 (see FIG. 2B). In this state, the displacement mechanism 8 fixes the vertical position of the core 1, and the pressure mechanism 7 applies a biasing force to the abutment body 2 acting to cause the abutment surface 21 to approach the core 1.

Next, the selection mechanism 11 causes the holding surface 61 of the holding body 6 to face the peripheral surface of the core 1 (see FIG. 2C), and the third biasing mechanism 10 moves down the holding body 6 and the selection mechanism 11 together. Simultaneously with a moment when the holding surface 61 comes into abutting contact with the peripheral surface of the core 1, the vertical position of the core 1 is released from the fixing by the displacement mechanism 8.

The downward pressing force acting from the third biasing mechanism 10 on the holding body 6 is larger than the upward pressing force acting from the pressure mechanism 7 on the abutment body 2. By causing the downward pressing force to act continuously from the third biasing mechanism 10 on the holding body 6, the core 1 is moved down integrally with the workpiece W and the abutment body 2 with the center portion of the workpiece W interposed between the core 1 and the abutment surface 21 on which the upward biasing force acts from the pressure mechanism 7. When the center of the core 1 reaches the reference plane P1, portions of the workpiece W from the center portion toward the both edge portions are deformed into a semi-circular shape along the peripheral surface of the core 1 while abutting on the arc-like part 32A of the first pressure member 3A and the arc-like part 32B of the second pressure member 3B (see FIG. 2D).

At a moment when the center of the core 1 reaches the reference plane P1, the first biasing mechanism 9A and the second biasing mechanism 9B apply pressing forces to the first pressure member 3A and the second pressure member 3B in directions of moving the first pressure member 3A and the second pressure member 3B closer to each other. The core 1 receives the pressing forces acting in four directions in total from the holding surface 61, the abutment surface 21, the arc-like part 32A of the first pressure member 3A, and the arc-like part 32B of the second pressure member 3B. The pressing force from the holding surface 61 and the pressing force from the abutment surface 21 face each other in the reference direction L1. The pressing force from the arc-like part 32A and the pressing force from the arc-like part 32B face each other across the reference direction L1.

By causing the pressure mechanism 7, the first biasing mechanism 9A, the second biasing mechanism 9B, and the third biasing mechanism 10 to supply the pressing forces continuously, portions of the workpiece W closer to the both edge portions than the portions deformed in the semi-circular shape are deformed into arc-like shapes along the peripheral surface of the core 1 while abutting on the arc-like part 32A and the arc-like part 32B. Immediately before the arc-like part 32A and the arc-like part 32B come into abutting contact with the holding body 6, supply of the pressing forces from the first biasing mechanism 9A, the second biasing mechanism 9B, and the third biasing mechanism 10 are stopped while supply of the pressing force from the pressure mechanism 7 is continued. Here, the positions of the first pressure member 3A and the second pressure member 3B are fixed in the reference direction L1. Thus, the core 1 stops moving down in a state of being interposed among these pressure members and the abutment body 2 by receiving the pressing force from the pressure mechanism 7 (see FIG. 2E).

Next, the third biasing mechanism 10 moves up the holding body 6, the selection mechanism 11 retreats the holding body 6 to a position where the holding surface 61 does not face the core 1, and the first biasing mechanism 9A and the second biasing mechanism 9B restart supplying the pressing forces. The core 1 restarts moving down and the first pressure member 3A and the second pressure member 3B make closest approach to each other (see FIG. 2F).

When the first pressure member 3A and the second pressure member 3B make closest approach to each other, portions of the workpiece W closer to the both edge portions than the portions abutting on the arc-like part 32A and the arc-like part 32B are separated from the peripheral surface of the core 1 in tangential directions without being pressed with the arc-like part 32A and the arc-like part 32B. Moreover, stress caused in the workpiece W by the deformation acts on the portions of the workpiece W abutting on the arc-like part 32A and the arc-like part 32B in directions of separating from the peripheral surface of the core 1. This separates the both edge portions of the workpiece W further from the peripheral surface of the core 1.

In response to this, the first pressure member 3A and the second pressure member 3B are moved farther from each other and the selection mechanism 11 causes the correcting surface 51 of the correcting body 5 to face the core 1 (see FIG. 2G). The third biasing mechanism 10 moves down the correcting body 5 toward the core 1 (see FIG. 2H). The both edge portions of the workpiece W are pressed with the correcting surface 51 to be deformed along the peripheral surface of the core 1. As a result, the workpiece W is formed into a circular cylindrical pipe having a shape with an inner peripheral surface entirely conforming to the peripheral surface of the core 1.

Then, the displacement mechanism 8 fixes the vertical position of the core 1, the first pressure member 3A and the second pressure member 3B are moved farther from each other by the first biasing mechanism 9A and the second biasing mechanism 9B, and the abutment body 2 is moved farther from the core 1 by the pressure mechanism 7. The workpiece W formed into the circular cylindrical pipe can be pulled out from one end side of the core 1 in the axis direction of the core 1.

Figures 3A, 3B, 3C, 3D, 3E, 3F, 3G, 3H:
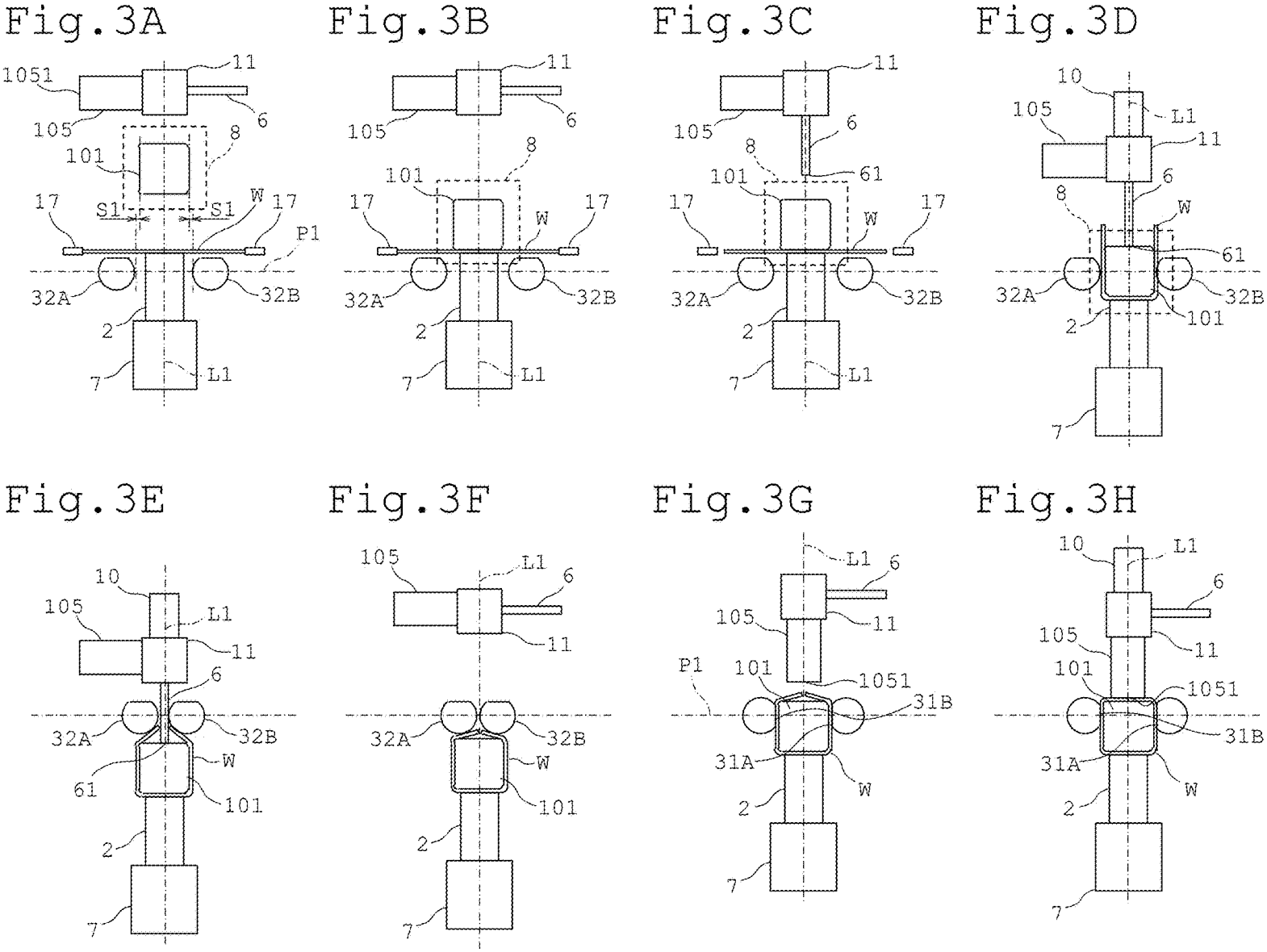
FIGS. 3A to 3H are side schematic views showing motions during forming into a quadrangular pipe body by the pipe body forming apparatus.

As shown in FIG. 3A, in order for the pipe body forming apparatus 100 to form a rectangular metallic flat plate as a workpiece W into a square pipe having a rectangular section, the displacement mechanism 8 holds a core 101 having an outer dimension corresponding to an inner dimension of the square pipe to be formed, and a correcting body 105 including a correcting surface 1051 of a planar shape is mounted on the selection mechanism 11. In this state, processes similar to those shown in FIGS. 2A to 2F are performed to deform an inner peripheral surface of the workpiece W into a shape along three sides of a peripheral surface of the core 101. By doing this, both edge portions and vicinities thereof of the workpiece W move closer to an upper surface of the core 101 (see FIGS. 3A to 3F).

When the both edge portions of the workpiece W move closer to the upper surface of the core 101, internal stress is caused in the workpiece W by the deformation. Thus, as the first pressure member 3A and the second pressure member 3B move farther from each other, the both edge portions of the workpiece W are separated from the upper surface of the core 101. In response to this, the abutment body 2 is moved up by the pressure mechanism 7 until the upper surface of the core 101 reaches a position above the reference plane P1, and the first pressure member 3A and the second pressure member 3B are rotated so as to cause the linear part 31A and the linear part 31B to face the core 101 across the workpiece W. Furthermore, the first pressure member 3A and the second pressure member 3B are biased so as to move closer to each other, and the selection mechanism 11 causes the correcting surface 1051 of the correcting body 105 to face the core 101 (see FIG. 3G).

From this state, the third biasing mechanism 10 moves down the correcting body 105 toward the core 101. By doing so, the both edge portions of the workpiece W are pressed with the correcting surface 1051 to be deformed in such a manner as to tightly contact the upper surface of the core 101. The state of the workpiece W tightly contacting both sides of the core 101 is maintained by pressing forces from the linear part 31A of the first pressure member 3A and the linear part 31B of the second pressure member 3B respectively. The workpiece W is formed into the square pipe of a shape having the inner dimension conforming to the outer dimension of the core 101 (see FIG. 3H).

Figure 4A:
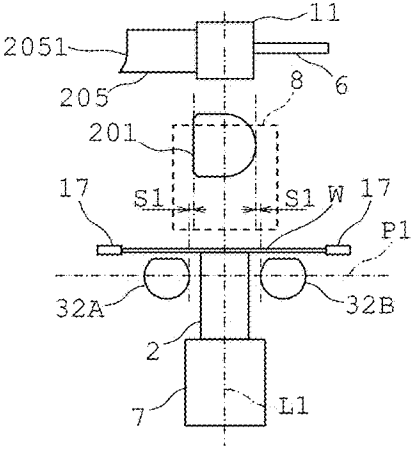
FIGS. 4A to 4H are side schematic views showing motions during forming into a D-shape pipe body by the pipe body forming apparatus.
Figure 4B:
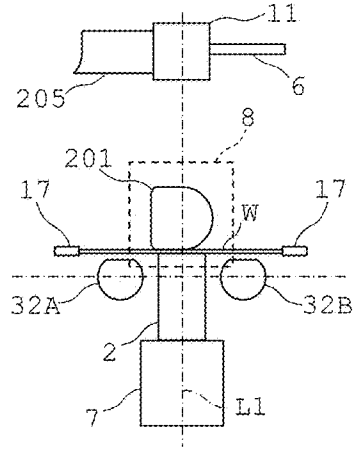
Figure 4C:
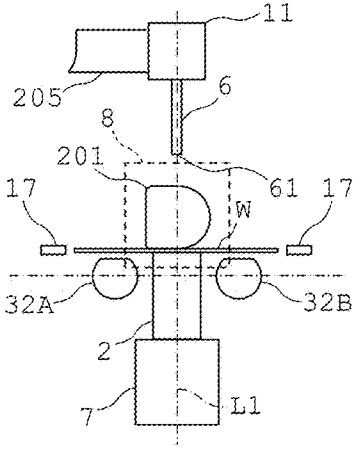
Figure 4D:
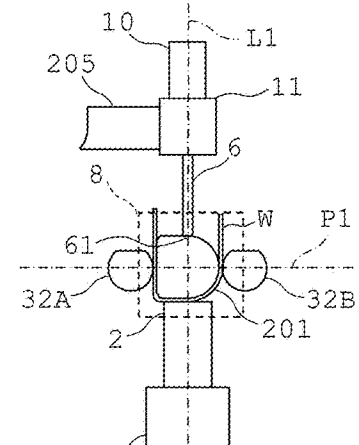
Figure 4E:
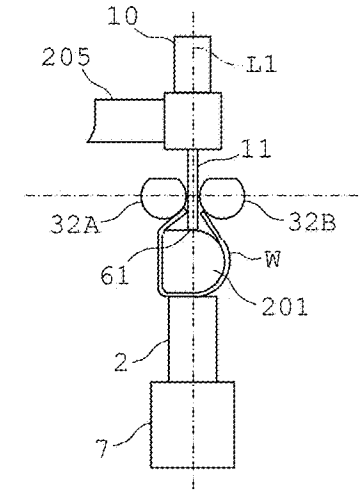
Figure 4F:
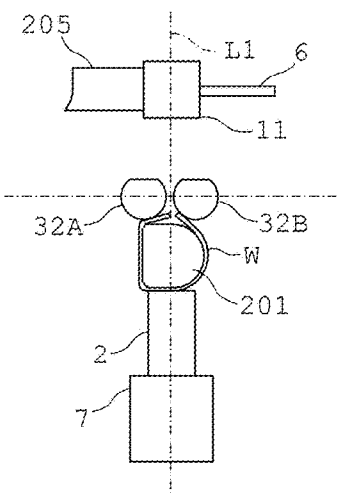

As shown in FIG. 4A, in order for the pipe body forming apparatus 100 to form a rectangular metallic flat plate as a workpiece W into a deformed pipe having a D-shape section, the displacement mechanism 8 holds a core 201 having an outer dimension corresponding to an inner dimension of the deformed pipe to be formed, and a correcting body 205 including a correcting surface 2051 of a planar shape is mounted on the selection mechanism 11. In this state, processes similar to those shown in FIGS. 2A to 2F are performed to deform a part of an inner peripheral surface of the workpiece W into a shape along two continuous planes and a part of a curved plane of a peripheral surface of the core 201. By doing this, both edge portions and vicinities thereof of the workpiece W move closer to an upper surface side of the core 201 (see FIGS. 4A to 4F).

Figure 4G:
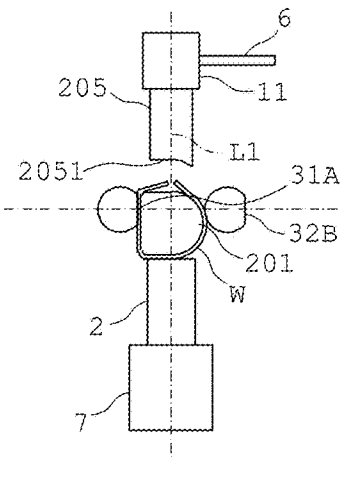

When the both edge portions of the workpiece W move closer to the upper surface of the core 201, internal stress is caused in the workpiece W by the deformation. Thus, as the first pressure member 3A and the second pressure member 3B move farther from each other, the both edge portions of the workpiece W are separated from the upper surface of the core 201. In response to this, the abutment body 2 is moved up by the pressure mechanism 7 until the upper surface of the core 201 reaches a position above the reference plane P1, and the first pressure member 3A and the second pressure member 3B are rotated so as to cause the linear part 31A and the arc-like part 32B to face the core 201 across the workpiece W. Furthermore, the first pressure member 3A and the second pressure member 3B are biased so as to move closer to each other, and the selection mechanism 11 causes the correcting surface 2051 of the correcting body 205 to face the core 201 (see FIG. 4G).

Figure 4H:
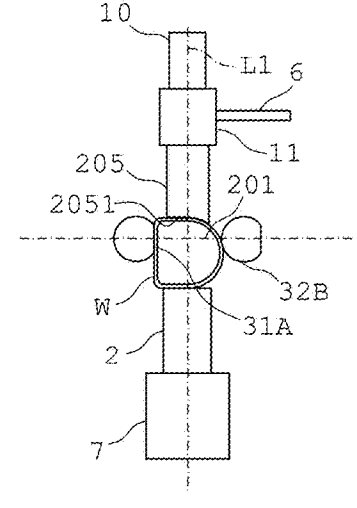

From this state, the third biasing mechanism 10 moves down the correcting body 205 toward the core 201. By doing so, the both edge portions of the workpiece W are pressed with the correcting surface 2051 to be deformed in such a manner as to tightly contact the upper surface side of the core 201. The state of the workpiece W tightly contacting both sides of the core 201 is maintained by pressing forces from the linear part 31A of the first pressure member 3A and the arc-like part 32B of the second pressure member 3B respectively. The workpiece W is formed into the deformed pipe of a shape having the inner dimension conforming to the outer dimension of the core 201 (see FIG. 4H).

As described above, according to the pipe body forming apparatus 100, using the core 1 responsive to a sectional shape of a pipe body to be formed allows forming into a pipe body having a section of any noncircular shape as well as a circular section, a rectangular section, or a D-shape section. Furthermore, using the holding body 6 having a length matching an axial length of a pipe body to be formed makes it possible to prevent deflection of the core 1 even in the case of a workpiece W having high hardness. This allows the workpiece W to be reliably formed into a long pipe body having any noncircular sectional shape.

Figure 5:
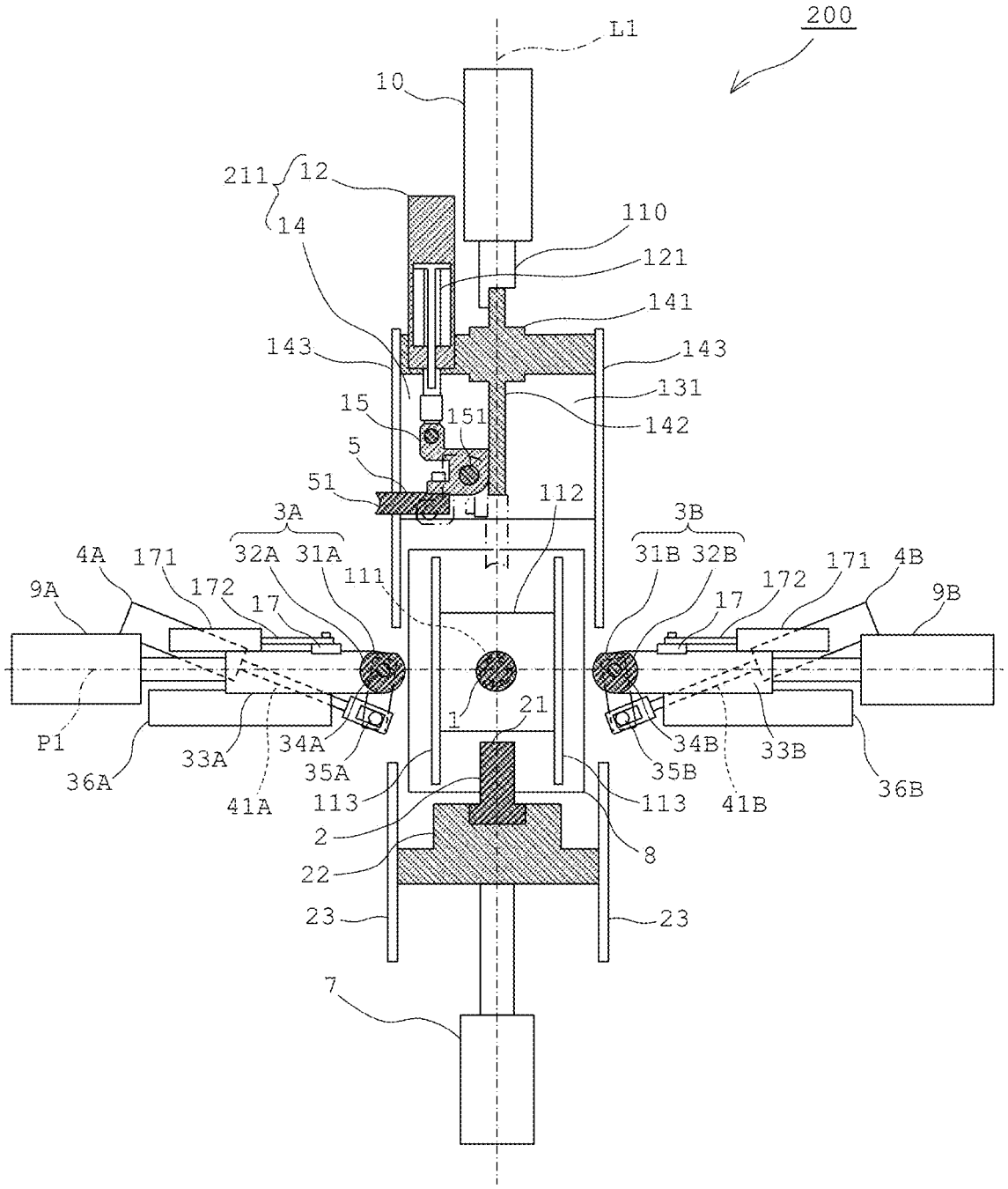
FIG. 5 is a sectional view of a pipe body forming apparatus according to a second embodiment of the present invention.
Figure 6A:
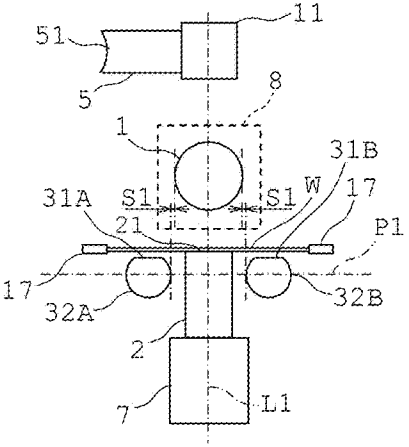
FIGS. 6A to 6H are side schematic views showing motions during forming into a circular pipe body by the pipe body forming apparatus in FIG. 5.
Figure 6B:
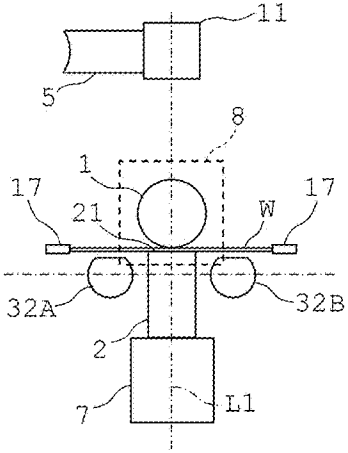
Figure 6C:
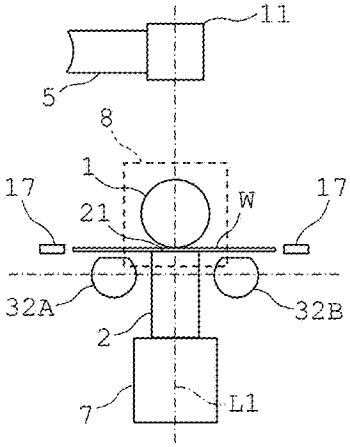
Figure 6D:
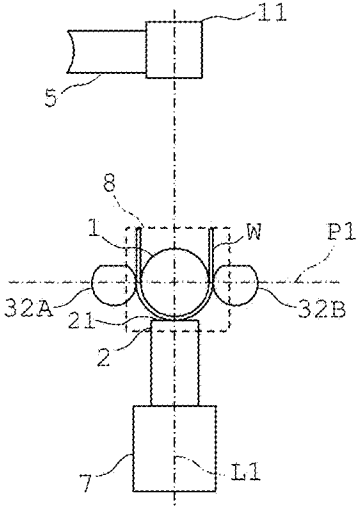
Figure 6E:
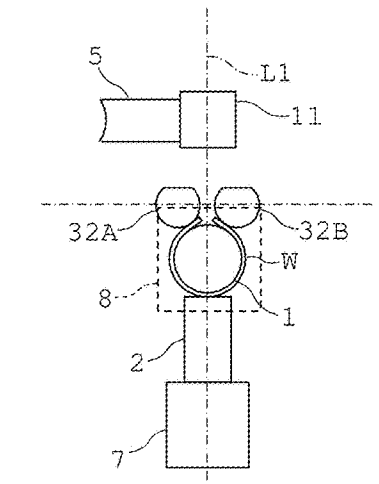
Figure 6F:
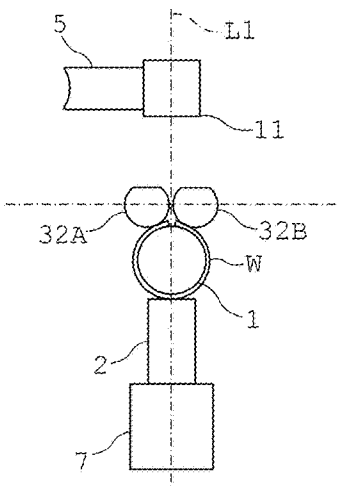
Figure 6G:
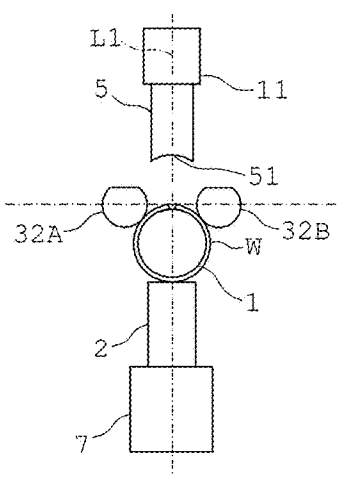
Figure 6H:
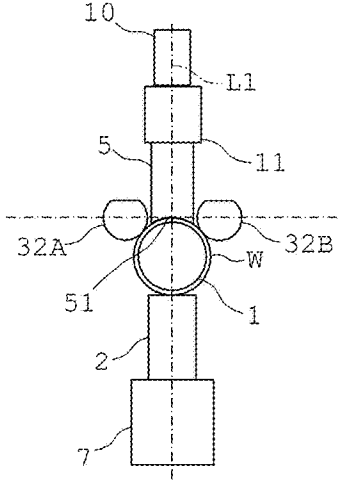

As shown in FIG. 5, a pipe body forming apparatus 200 according to a second embodiment of the present invention includes a selection mechanism 211 instead of the selection mechanism 11 of the pipe body forming apparatus 100 and does not include the holding body 6 of the pipe body forming apparatus 100. The other configuration of the pipe body forming apparatus 200 is the same as that of the pipe body forming apparatus 100. In response to the deletion of the holding body 6, the holding body cylinder 13 and the holding body link 16 of the selection mechanism 11 are omitted from the selection mechanism 211. The pipe body forming apparatus 200 is to form a rectangular metallic flat plate as a workpiece W having low hardness into a short pipe body having a circular section.

At the selection mechanism 211, by supplying a fluid selectively to the correcting body cylinder 12, the upper surface of the correcting body 5 comes into abutting contact with the lower surface of the pressure part 142 and the correcting surface 51 comes to face the peripheral surface of the core 1. During pipe body forming, the pipe body forming apparatus 200 selectively causes the correcting surface 51 to face the peripheral surface of the core 1 with the selection mechanism 211.

When the pipe body forming apparatus 200 forms a rectangular metallic flat plate having low hardness as a workpiece W into a short pipe body having a circular section, no deflection occurs at the core 1. Thus, as shown in FIGS. 6A to 6F, pressing of the core 1 by the holding body 6 shown in FIGS. 2C to 2E is omitted during pipe body forming by the pipe body forming apparatus 200. During forming of rectangular metallic flat plates having low hardness as workpieces W into a short square pipe and a short deformed pipe having a D-shape section, pressing of the core 1 by the holding body 6 shown in FIGS. 3C to 3E and FIGS. 4C to 4E are also omissible.

What is claimed is:

1. A pipe body forming apparatus comprising:

a core that is a columnar body having a sectional shape uniform in an axis direction thereof and restricted in rotation about an axis;

an abutment body including an abutment surface movable closer to and farther from the core relatively in a reference direction corresponding to a particular radial direction of the core, to face the core over an entire area of the core in the axis direction, and used for interposing a plate-like workpiece in the reference direction between the abutment surface and the core;

a first pressure member and a second pressure member each being a columnar body having a sectional shape that is uniform in an axis direction thereof and has an outer periphery including a linear part and an arc-like part, the first pressure member and the second pressure member being arranged parallel to the core within a reference plane perpendicular to the reference direction while being movable closer to and farther from each other across the reference direction;

a first rotary mechanism configured to cause the linear part and the arc-like part of the first pressure member selectively to face the core;

a second rotary mechanism configured to cause the linear part and the arc-like part of the second pressure member selectively to face the core;

a correcting body including a correcting surface configured to face the core over an entire area of the core in the axis direction on an opposite side to the abutment body across the core, the correcting surface conforming to a peripheral surface of the workpiece interposed between the abutment surface and the core, the correcting body being supported movably in the reference direction relative to the core;

a pressure mechanism that allows the core and the abutment surface to interpose the workpiece therebetween;

a displacement mechanism that changes a relative position of the workpiece to the reference plane in the reference direction with the workpiece interposed between the core and the abutment surface;

a first biasing mechanism and a second biasing mechanism that respectively bias the first pressure member and the second pressure member in directions of moving the first pressure member and the second pressure member closer to each other while the workpiece interposed between the core and the abutment surface moves from an initial position to a finish position across the reference plane along with the change in the relative position; and a third biasing mechanism that allows the correcting surface to be pressed against a peripheral surface of the core with opposing edge portions of the workpiece interposed between the correcting surface and the core, between the first pressure member and the second pressure member moved farther from each other after the workpiece reaches the finish position.

2. The pipe body forming apparatus according to claim 1, further comprising:

a holding body including a holding surface configured to face the core over an entire area of the core in the axis direction on an opposite side to the abutment body across the core, the holding body being supported movably in the reference direction relative to the core; and a fourth biasing mechanism that brings the holding surface and the peripheral surface of the core into pressure-contact with each other in a period from when the workpiece interposed between the core and the abutment surface moves from the initial position to when the workpiece passes through at least the reference plane along with the change in the relative position.

3. The pipe body forming apparatus according to claim 2, further comprising:

a selection mechanism that supports the correcting body and the holding body integrally and movably in the reference direction and causes either the correcting surface or the holding surface to face the core selectively, wherein the third biasing mechanism functions as the fourth biasing mechanism.

4. The pipe body forming apparatus according to claim 1, wherein the displacement mechanism moves the core in the reference direction between the initial position and the finish position for the workpiece.

* * * * *